United States Patent [19]

Castiglia

[11] 4,306,315

[45] Dec. 22, 1981

[54] SHIN GUARD

[75] Inventor: Ignatius F. Castiglia, New York, N.Y.

[73] Assignee: Casco Marketing Corporation, Pompano Beach, Fla.

[21] Appl. No.: 34,435

[22] Filed: Apr. 30, 1979

[51] Int. Cl.[3] ..... A41D 13/00

[52] U.S. Cl. ..... 2/22; 36/2 R

[58] Field of Search ..... 2/22; 36/1.5, 2 R; 128/80 R, 80 C, 80 B, 165

[56] References Cited

U.S. PATENT DOCUMENTS

| | | | |
|---|---|---|---|
| 2,544,065 | 3/1951 | Carr | 2/22 |
| 3,621,489 | 11/1971 | Keller | 36/2 R |
| 3,735,419 | 5/1973 | Byrd | 2/22 |
| 4,001,953 | 1/1977 | Fugere | 2/22 |

FOREIGN PATENT DOCUMENTS

| | | | |
|---|---|---|---|
| 1564324 | 3/1969 | France | 2/22 |

*Primary Examiner*—Doris L. Troutman

*Attorney, Agent, or Firm*—Frishauf, Holtz, Goodman and Woodward

[57] ABSTRACT

A shin guard comprises an elastic generally tubular member adapted to tightly surround the lower leg of a wearer in the vicinity of the shin, and an elongated substantially rigid member which is tapered toward the lower end thereof and being generally shaped to substantially conform to the contour of the shin of the wearer. The elastic tubular member has a first retaining means for retaining the substantially rigid member in a predetermined position between the elastic tubular member and the shin of the wearer. A second retaining means extends from the elastic tubular member for retaining the elastic tubular member in the longitudinal direction thereof substantially at a predetermined position on the leg of the wearer.

6 Claims, 7 Drawing Figures

SHIN GUARD

CROSS-REFERENCE TO RELATED APPLICATION

Design Application Ser. No. 34,657 filed Apr. 30, 1979, the entire contents of which are incorporated herein by reference.

BACKGROUND OF THE INVENTION

This invention relates to a shin guard, and more particularly to a shin guard having an elastic stocking-like member and a rigid protective member inserted therein.

The object of the present invention is to provide a shin guard which not only protects the shin or front lower leg of the wearer against injury from blows, for example inflicted during participation in athletic sports, but which also gives tight compressive support to the rear portion of the leg, namely the gastric nemius muscle. A further object of the invention is to provide such a shin guard which has a rigid member extending along the front portion of the lower leg of the wearer to redistribute forces of any blows. Still further, it is an object of the present invention to provide such a rigid member which is tapered to conform to the fibula, and which is preferably made of heat formable material so that it can be molded to substantially conform to the front leg portion of any wearer.

SUMMARY OF THE INVENTION

According to the present invention, a shin guard comprises an elastic generally tubular member adapted to tightly surround the lower leg of a wearer in the vicinity of the shin; and an elongated substantially rigid member which is tapered toward the lower end thereof to substantially conform to the fibula of a wearer, the elongated substantially rigid member being shaped to substantially conform to the contour of the shin of the wearer. The elastic tubular member has a first retaining means for retaining the substantially rigid member in a predetermined position interior of the elastic tubular member and between the elastic tubular member and the shin of the wearer; and a second retaining means extends from the elastic tubular member for retaining the elastic tubular member in the longitudinal direction thereof substantially at a predetermined position on the leg of the wearer.

Preferably, the first retaining means comprises an elongated pocket formed in the elastic tubular member and into which the substantially rigid elongated member is removably insertable. The elastic tubular member also preferably tightly and compressively surrounds the lower leg of the wearer in the vicinity of the shin. The substantially rigid member is preferably a heat deformable plastic material.

DETAILED DESCRIPTION

Figure 1:
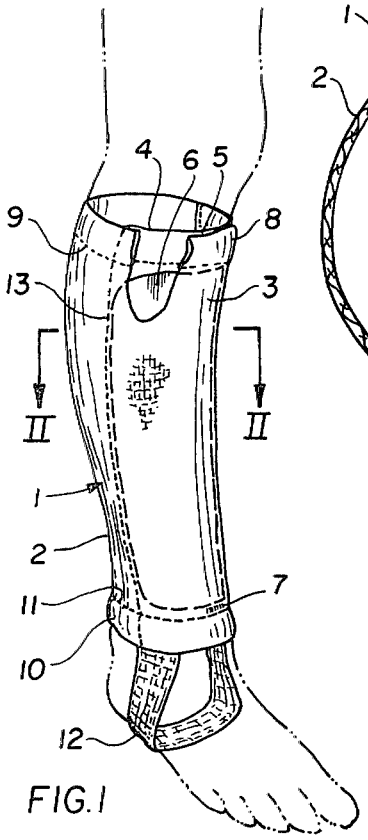
FIG. 1 is a perspective view of a shin guard mounted on the leg of a wearer.

FIG. 1 illustrates the shin guard of the present invention installed on the leg of a wearer. The shin guard comprises a tubular stocking-like portion 1 formed of elastic material, the elastic material comprising a rear elastic portion 2 which tightly extends around the rear portion of the lower leg of the wearer to provide compressive elastic support to the gastric nemius muscle. The elastic stocking portion also comprises a front portion 3 which extends tightly around the front portion of the leg of a wearer and an intermediate elastic portion 4 which is joined to the rear portion 2 and front portion 3 to form a pocket 5 for receiving a removable molded insert 6 (see FIG. 4) which is positively and securely retained in the pocket 5. The molded insert 6 is retained in the pocket 5 by virtue of the fact that it is molded to conform with the front surface areas of the wearer which are to be protected, and by virtue of the fact that it is tightly and elastically retained in the pocket 5 by the tight compressive fit of the elastic stocking 1 over the leg of the wearer. Preferably, the stocking extends a substantial portion above the top of the molded insert 6 to compressively close off the top of the pocket 5 to aid in retaining the molded insert 6 in place. The lower portion of the stocking is stitched at 7 to provide a "stop" for the molded insert 6 to prevent it from coming out of the bottom portion of the stocking. The seam 7 may be a spot-seam as illustrated in FIG. 1, or may extend completely across the lower portion of the pocket 5. The stocking 1 has a doubled or turned-over top cuff 8 which is stitched at seam 9. The top cuff 8 aids in keeping the stocking 1 in place. The stocking preferably also comprises a lower doubled or turned-over bottom cuff 10 formed by means of stitching 11. A stirrup 12 made of elastic material is attached to the bottom portion of the stocking 1, for example by sewing, to extend under the foot of the wearer, as illustrated in FIG. 1, to help retain the stocking in proper position on the wearer's leg. The stirrup 12 may be formed of inelastic material, as desired. Elastic material, however, has been found preferable for ease of installation and comfort in use.

Figure 2:
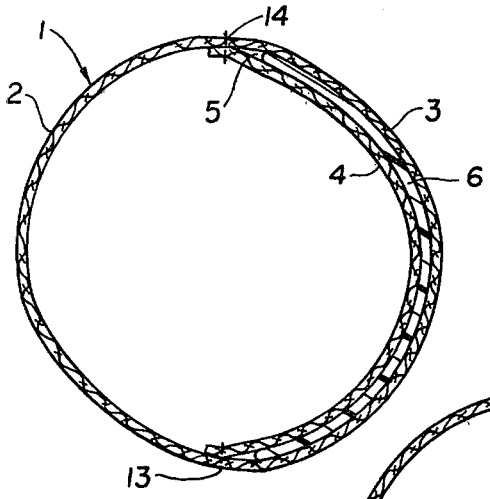
FIG. 2 is a cross-sectional view of the shin guard of FIG. 1 taken along the line II-II in FIG. 1, the wearer's leg being omitted.

FIG. 2 illustrates a cross-sectional view of the stocking and molded insert, the portions 2 and 3 comprising a single tubular stocking-like member and the inner elastic material 4 being seemed to the outer stocking 2, 3 by means of seams 13, 14 which define the outer longitudinal extremities of the pocket 5. The pocket 5 is preferably dimensioned so that the longitudinal edges 15, 16 of the molded insert 6 elastically bear against the portions of the stocking in the vicinity of the seams 13, 14 to further aid in retaining the molded insert 6 in position relative to the elastic stocking.

Figure 3:
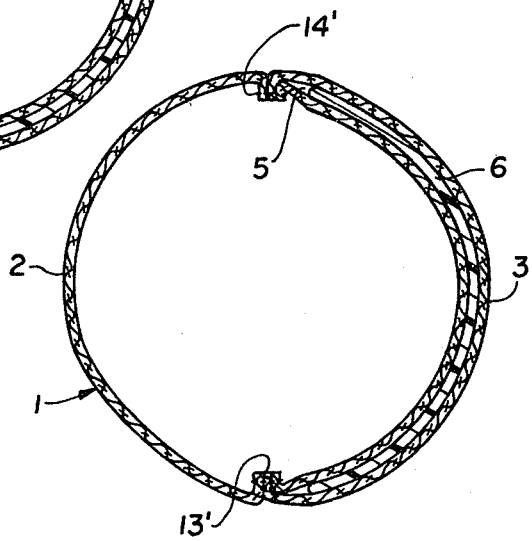
FIG. 3 is a cross-sectional view, similar to FIG. 2, but of a modified form of the invention.

FIG. 3 illustrates an embodiment similar to that of FIG. 2, but wherein the elastic material members 2, 3 and 4 are individual pieces of material seamed together at seams 13', 14'. Functionally, the embodiment of FIG. 3 is identical to that of FIG. 2.

Figure 4:
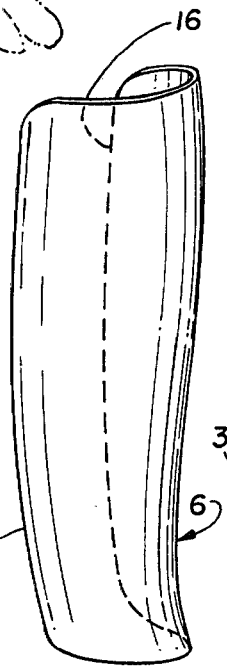
FIG. 4 is a perspective view of a molded plastic insert of the shin guard of the present invention.

FIG. 4 illustrates the molded plastic insert 6, out of the pocket 5 of the stocking 1. The molded plastic insert 6 is a substantially rigid member of heat-deformable material. The plastic member 6 is heated in order to make same somewhat flexible, and it is then molded or formed to generally or exactly conform with the surface of the wearer which is to be protected. Any of the well-known heat-deformable rigid plastic orthopedic sheets presently available in the art can be used. One preferable material is the plastic sheet material disclosed in U.S. Pat. No. 3,906,943, the entire contents of which are incorporated herein by reference. The plastic material may be used alone or covered with a fabric as described in U.S. Pat. No. 3,906,943. The insert 6 is heat formed to conform to the body portion of the wearer against which it is to be adjacent, and is then cooled. When cooled, the material retains the formed shape and becomes rigid.

Figure 5:
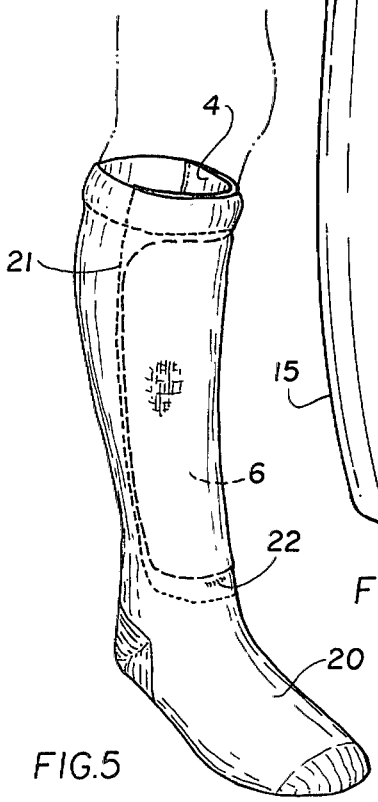
FIG. 5 is a perspective view of a modified shin guard installed on the leg of a wearer.

FIG. 5 illustrates an embodiment similar to that of FIG. 1, but wherein the lower end of the stocking has a foot and toe enclosure 20. This arrangement eliminates the stirrup, but adds a lower portion of the stocking which is similar to a conventional stocking or sock. While this embodiment is more expensive than the embodiment shown in FIG. 1, in some instances it may be preferable. The rear pocket forming elastic sheet 4 is stitched to the outer elastic stocking-forming sheets at stitching 21 on both sides thereof. At the bottom, a stitching 22, or the like, may be provided to serve as a "stop" to prevent the insert 6 from sliding down. Operationally, the embodiment of FIG. 5 is substantially identical with that of FIG. 1.

Figure 6:
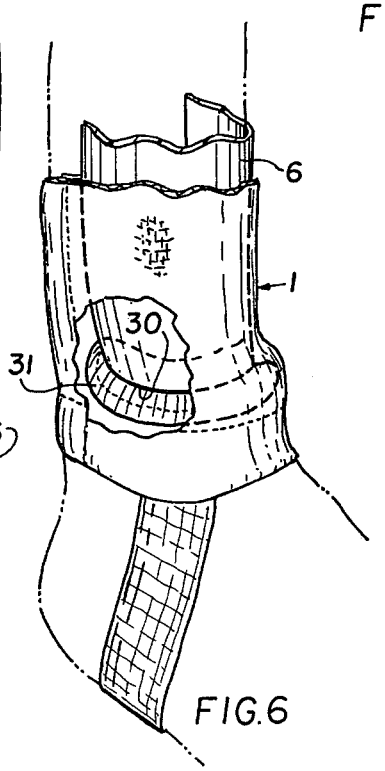
FIG. 6 is a partial perspective view of a modified version of the shin guard of FIG. 1.

FIG. 6 illustrates a further embodiment of the invention wherein the lower portion of the stocking in the vicinity of the lower edge 30 of the plastic insert 6 is provided with a padding 31 to further protect the lower leg area of the wearer. The padding 31 may be permanently secured to the inside lower portion of the stocking 1 by means of stitching, adhesives, or any other suitable attachment means.

Figure 7:
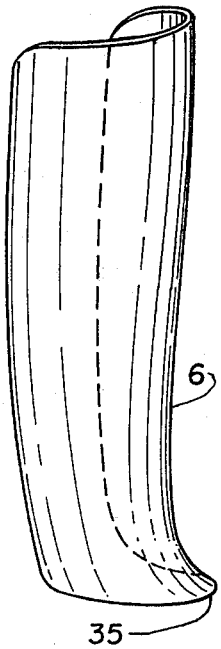
FIG. 7 is a perspective view of a modified molded plastic insert which is outwardly flared at the lower end thereof.

FIG. 7 illustrates a modified plastic liner 6 having a lower edge 35 which is flared outwardly of the leg of the wearer to further prevent the lower end of the liner 6 from digging into the foot of the wearer. The liner 6 with the outwardly flared lower end 35 can be used in conjunction with the padding illustrated in FIG. 6 to further prevent harm to the lower leg portion of the wearer.

In accordance with the present invention, the elastic stocking 1 is fabricated so as to tightly surround the lower leg of the wearer in the vicinity of the shin in order to not only hold the stocking securely in place on the leg, and hold the liner 6 securely in place, but also to provide compressive support to the muscles in the lower leg of the wearer. The plastic insert 6 is moldable, rigid material which is tapered toward the lower end to conform to the fibula of the wearer. The rigid plastic insert 6 is effective to substantially prevent hard blows to the shin from damaging or otherwise hurting the wearer, and distributes any blows to the shin substantially along the complete length of the plastic insert, thereby lessening the impact and substantially eliminating any possibility of localized high forces being applied to the shin of the wearer. The feature of redistributing the force of the blow is extremely important and is one of the main advantages of the device of the present invention. Moreover, since individual straps, etc. are eliminated, the device of the present invention is easy to use, easy for the wearer to install, and maintains itself in proper position even during violent and rough sports, such as football, hockey, soccer, or the like. Still further, by virtue of the compressive forces applied by the elastic stocking, support is provided for the muscles in the rear portion of the lower leg of the wearer. Since straps and other individual securing elements are eliminated, localized forces are not applied to the rear portion of the wearer, thereby increasing comfort.

I claim:

1. A shin guard comprising:

an elastic generally tubular member (1) adapted to tightly surround the lower leg of a wearer in the vicinity of the shin;

an elongated substantially rigid member (6) which is tapered toward the lower end thereof to substantially conform to the fibula of a wearer, said elongated substantially rigid member being shaped to substantially conform to the contour of the shin of the wearer;

said elastic tubular member having means defining an elongated open ended pocket for receiving and removably retaining said substantially rigid member through said open end in a predetermined position interior of said pocket of said elastic tubular member and between a portion of said elastic tubular member and the shin of the wearer;

said pocket having stop means at the lower end thereof for limiting the insertion depth of said substantially rigid member into said pocket to a position above and spaced from the foot of a wearer, thereby retaining the lowermost edge of said substantially rigid member spaced from the foot of a wearer;

cushion means at the lower end of said elongated substantially rigid member and located between said substantially rigid elongated member and the foot of a wearer;

said elastic tubular member being adapted to tightly and compressively surround the lower leg portion of a wearer to provide compressive support to the gastric nemius muscle of the wearer; and a stirrup (12) extending from the lower edge of said elastic tubular member and adapted to extend around the foot of the wearer for retaining said elastic tubular member in the longitudinal direction of said elastic tubular member substantially at a predetermined position on the leg of the wearer.

2. The shin guard of claim 1 wherein said stop means comprises stitching at the lower end of said pocket for stitching the pocket material to said elastic tubular member.

3. The shin guard of claim 1 wherein said elastic tubular member extends a predetermined distance above said substantially rigid elongated member for compressively closing off said first retaining means.

4. The shin guard of either of claims 1 or 2 wherein said pocket comprises a sheet of elastic material secured to said elastic tubular member.

5. The shin guard of claim 4 wherein said sheet of elastic material is stitched to the elastic tubular member to form said pocket.

6. The shin guard of claim 1 wherein said substantially rigid elongated member is a heat moldable plastic member.

* * * * *